US006763797B1

(12) United States Patent
Staley et al.

(10) Patent No.: US 6,763,797 B1
(45) Date of Patent: Jul. 20, 2004

(54) ENGINE OIL SYSTEM WITH VARIABLE DISPLACEMENT PUMP

(75) Inventors: David R. Staley, Flushing, MI (US); Rolland D. Giampa, Caro, MI (US); Alan W. Hayman, Romeo, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/350,505

(22) Filed: Jan. 24, 2003

(51) Int. Cl.[7] ..... F01M 1/00; F01M 1/02; F16N 13/20

(52) U.S. Cl. ..... 123/196 R; 418/26; 184/31

(58) Field of Search ..... 123/196 R; 184/6, 184/16, 31; 418/26

(56) References Cited

U.S. PATENT DOCUMENTS 4,342,545 A 8/1982 Schuster ..... 418/26
4,473,341 A * 9/1984 Ohe et al. ..... 417/299
4,927,332 A * 5/1990 Fischer et al. ..... 417/299
5,141,418 A * 8/1992 Ohtaki et al. ..... 418/26
5,190,004 A * 3/1993 Iwata ..... 123/196 R
5,842,451 A * 12/1998 von Eisebeck et al. . 123/196 R
6,601,557 B1 * 8/2003 Hayman et al. ..... 123/192.2
2002/0139345 A1 * 10/2002 Takahara et al. ..... 123/196 R

FOREIGN PATENT DOCUMENTS

WO WO9632570 * 10/1996

* cited by examiner

*Primary Examiner*—Andrew M. Dolinar
*Assistant Examiner*—Katrina B. Harris
(74) *Attorney, Agent, or Firm*—Karl F. Barr, Jr.

(57) ABSTRACT

A lubrication system for an internal combustion engine includes a variable displacement oil pump supported on the engine block and connected to draw oil from the oil pan and to supply pressurized oil to various engine components. The pump defines variable displacement pumping chambers for carrying oil from an inlet to a pressurized outlet. An exemplary embodiment includes a vane pump with a feedback displacement control using pressure from the lubrication system to actuate a slide ring in the pump to control the pump output. Numerous features of the pump are disclosed.

18 Claims, 2 Drawing Sheets

ENGINE OIL SYSTEM WITH VARIABLE DISPLACEMENT PUMP

TECHNICAL FIELD

This invention relates to engine lubrication systems and, more particularly, to variable displacement pumps for supplying engine oil to internal combustion engines.

BACKGROUND OF THE INVENTION

It is known in the art relating to engine oil pumps to use positive displacement pumps to supply pressurized oil to lubrication and hydraulic systems of the engine. These pumps are typically fixed displacement pumps that rely on a pressure responsive valve to regulate maximum oil pressure, thus regulating engine oil flow. Automotive engines have used both external pinion gears, commonly referred to as spur gear pumps, and internal/external pinion gears, commonly referred to as gerotor, crescent, etc., gear pumps, to serve as the pumping elements. Because these are fixed displacement pumps, their output flow is directly proportional to their operational speed. Similarly, the torque required to drive these pumps is proportional to both the pressure rise across the pump and their theoretical displacement. As used in automotive engines that directly drive the pumps, the drive torque of these pumps increases directly with the engine operating speed.

Use of fixed displacement pumps to supply a minimum oil pressure under hot idle conditions requires using a pump that is larger in displacement than is needed for providing adequate oil flow and pressure at other engine speeds where oil flow is increased and oil pressures are higher.

Thus, at speeds other than idle, use of a fixed displacement pump creates a significant parasitic energy loss for the engine.

SUMMARY OF THE INVENTION

The present invention provides a variable displacement vane engine oil pump which is small in size, has excellent volumetric efficiency at low speeds and significantly reduces parasitic losses at speeds greater than idle.

In a specific embodiment, a variable displacement vane pump includes a housing inside of which a slide ring is retained within the housing wall by a slide ring pivot. A rotor with slide vanes and a hex shaft drive of the rotor are located within the slide ring. Inlet and outlet ports allow fluid to enter and exit the pumping volume within the slide ring. A pick-up tube extends from the bottom of the pump and connects with the inlet port. A modular pressure relief valve assembly screws into a pump outlet passage.

A flange extends from the slide ring on a side opposite the slide ring pivot. The flange acts as a slide stop, a slide seal support, and a slide spring tab. A slide seal is attached to the slide seal support and extends beyond the slide seal support to sealingly engage the housing wall. A pressure control chamber is formed in a space between the housing wall, the slide ring, the slide stop and the slide seal. A reaction spring is located between the housing wall and the slide spring tab and is opposite the pressure control chamber. The spring urges the slide ring toward a maximum displacement position of the rotor wall.

A variable displacement vane pump in accordance with the invention may be driven by a camshaft through a cross-axis gear that turns the pump at a slower rate than the engine crankshaft speed. A ported pressure signal from a rear main bearing cap, to which the pump is mounted by a single bolt, acts on the pump's slide ring to cause it to pivot against the spring, thereby decreasing the pump's displacement. Use of the ported pressure signal provides a closed loop pressure control from the backside of the crankshaft rear main bearing, which prevents pressure sag in the engine lubrication system due to high component flow restriction or oil aeration.

The slide is sealed on its end opposite the pivot and outside the slide stop, which biases the pressure required to initiate the slide ring movement. Once the slide ring moves off its stop, the pressure signal acts on a larger area of the slide ring to further move it until the force becomes balanced with a reaction spring. As a result, the pump is capable of producing a relatively flat oil pressure regulation curve. A modular pressure relief ball valve assembly attached to the pump outlet further limits pressure transients under cold engine conditions.

Inlet and outlet ports of the pump are preferably on opposite sides of the vanes, which prevents the entrapment of gases in the pump chambers. The combination of the slide stop, the slide seal support and the slide spring tab into one component also aids in keeping the size of the pump small.

These and other features and advantages of the invention will be more fully understood from the following description of certain specific embodiments of the invention taken together with the accompanying drawings.

DESCRIPTION OF THE PREFERRED EMBODIMENT

Figure 1:
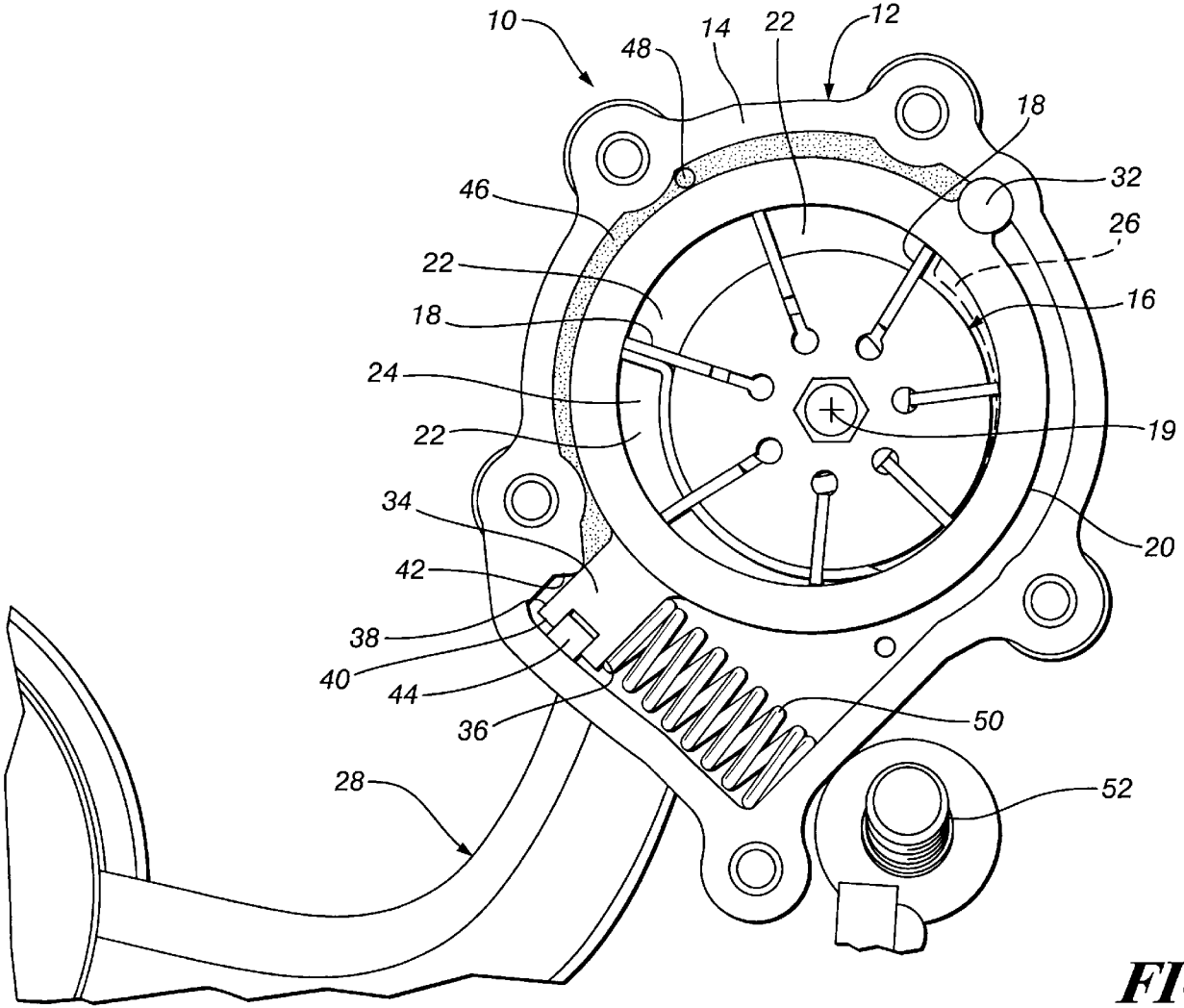
FIG. 1 is a plan view of the vane engine oil pump of the invention with the top cover of the housing removed to show internal elements of the pump.

Referring now to the drawings in detail, numeral 10 generally indicates a variable displacement vane engine oil pump in accordance with a specific embodiment of the present invention. As is more fully hereinafter described, the variable displacement vane pump 10 provides for more efficient pumping of engine oil and improved regulation of engine oil pressure.

As illustrated in FIG. 1, variable displacement vane pump 10 includes a housing 12 having a wall 14. A rotor 16 having a plurality of slide vanes 18 is rotatable in the housing on a fixed axis 19. The slide vanes 18 internally engage a slide ring 20 to define pumping chambers 22 within the slide ring 20. Vane rings (not shown) float in counterbores on opposite sides of the rotor 16 and engage inner edges of the slide vanes 18 to help them maintain contact with the slide ring 20. An inlet port 24 is formed in an inlet side 25 of the housing 12 and an outlet port 26 (shown in phantom in FIG. 1) is formed in an outlet side or top cover 27 of the housing (shown in FIG. 2). The ports 24, 26 communicate with the pumping chambers 22 in the slide ring 20 on opposite bottom and top sides of the rotor 16.

An oil pick-up tube 28, attached to the inlet side 25 of the housing 12, connects to the inlet port 24 and extends below and away from the housing 12. The rotor 16 is powered by a cross-axis hex shaft drive 30. Rotation of the rotor 16 by the shaft drive 30 causes oil to be sucked into the pumping chambers 22 through the inlet port 24 and pushed out of the pumping chambers 22 through the outlet port 26.

The slide ring 20 is pivotally retained against the housing wall 14 by a slide ring pivot 32. A flange 34 extends outward from the slide ring 20 at a location opposite from the slide ring pivot 32. The flange 34 includes a slide spring tab 36, a slide stop 38 and a slide seal support 40. The slide seal support 40 is perpendicular to the slide spring tab 36 and the slide stop 38 while the slide spring tab 36 is on a side of the flange 34 opposite from the slide stop 38. The slide stop 38 contacts a protrusion 42 on the housing wall 14 when the pump is operating at maximum displacement. The slide seal support 40 carries a slide seal 44 that extends radially beyond the slide stop 38 to engage the housing wall 14.

A pressure control chamber 46 is defined by the housing wall 14, the slide ring pivot 32, the slide ring 20, the slide stop 38 and the slide seal 44. An oil pressure signal port 48 is located in the housing 12 and communicates with the pressure control chamber 46. A reaction spring 50 is disposed between the housing wall 14 and the slide spring tab 36. A mounting bolt 52 on the outside of the housing 12 provides for attachment of the vane pump 10 to an engine body.

Figure 2:
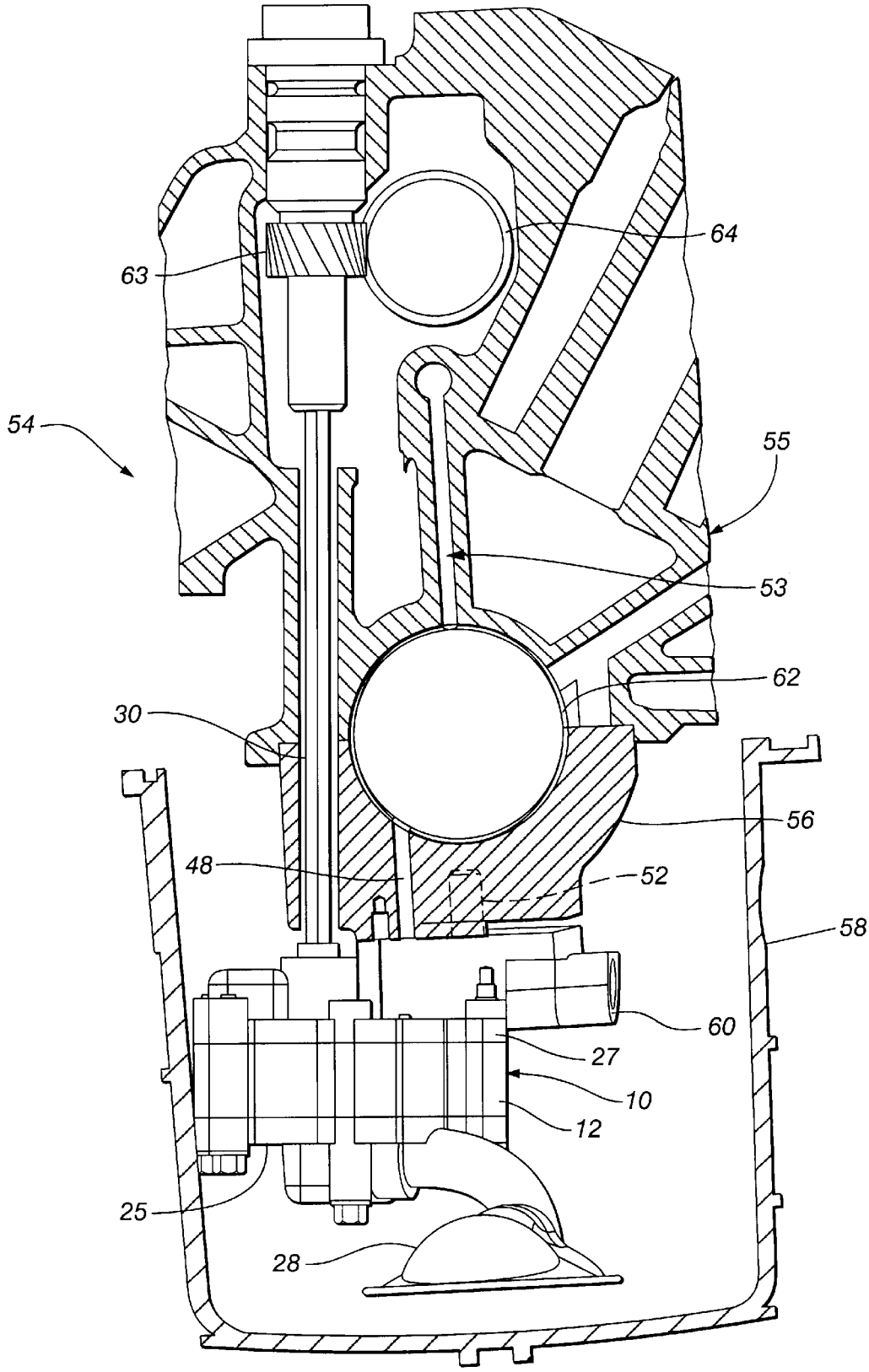
FIG. 2 is a cross-sectional view of portions of an engine showing the pump mounting and drive connected in the engine oil lubrication system.

In FIG. 2, the variable displacement vane engine oil pump 10 is shown integrated into an engine oil lubrication system 53 of an automotive internal combustion engine 54 having a cylinder block 55. The vane pump 10 is attached to the bottom of a rear main bearing cap 56 by the mounting bolt 52. The vane pump 10 is located below the bearing cap 56 within the engine oil pan 58. The oil pick-up tube 28 extends close to the bottom of the oil pan 58 to draw in oil from the pump in a conventional manner.

A modular pressure relief ball valve 60 is screwed into the top cover 27 and communicates with the outlet port 26. The oil pressure signal port 48 connects the pressure control chamber 46 of the pump 10 through the rear main bearing cap 56 to the crankshaft oil feed on the backside of the rear main bearing 62. The cross-axis hex shaft drive 30 extends from a driven gear 63 near the upper end of the engine cylinder block 55 and down into the vane pump 10 through the top cover 27 of the housing 12 and is powered by rotation of a camshaft drive gear 64 when the engine 54 is running.

Referring now to both FIGS. 1 and 2, the vane pump 10 is integrated into the oil lubrication system 53 of the engine 54 to efficiently maintain engine oil pressure. During operation of the engine, the camshaft drive gear 64 turns the cross-axis hex shaft drive 30, which in turn causes the rotor 16 inside the vane pump 10 to rotate on its axis 19. The spinning of the rotor 16 causes oil to be drawn from the bottom of the oil pan 58 through the oil pick-up tube 28 into the pumping chambers 22 and forced out to the oil lubrication system 53 through the outlet port 26. As the engine 54 and vane pump 10 operate, oil flow is generated by the vane pump 10 and an oil pressure signal (an indication of the relative system oil pressure) is sent from the rear main bearing cap 56 of the engine 54 through the oil pressure signal port 48 into the pressure control chamber 46 of the vane pump 10, creating a closed loop pressure control system. Hence, the oil pressure in the pressure control chamber 46 varies with that in the oil lubrication system.

During operation of the engine 54 at idle speed, engine oil pressure is low but must be kept above a certain minimum oil pressure. Since the oil pressure within the pressure control chamber 46 is equally low, the force of the reaction spring 50 against the flange 34 is greater than the force of the oil pressure in the pressure control chamber 46 acting against the slide ring 20, so that the slide stop 38 is forced into contact with the protrusion 42. In this orientation, the slide ring 20 is at its greatest eccentricity from the rotor axis 19 which results in maximum displacement of the vane pump 10. This maintains the minimum required oil pressure in the engine 54 while rotational speeds of the engine 54 and the vane pump 10 are at their slowest.

As engine speed is increased from idle, the relative speed of the vane pump 10 increases, thus increasing the pump outlet flow. This, in turn, increases the pressure in the engine oil system, including the pressure control chamber 46. When the force of oil pressure in the pressure control chamber 46 acting on the slide ring 20 becomes greater than the counteracting force of the reaction spring 50, the slide ring is pivoted about the slide ring pivot 32, moving the slide stop 38 away from the housing wall 12. The pivoting movement of the slide ring 20 about the slide ring pivot 32 reduces the eccentricity between the slide ring 20 and the rotor 16. This alters the orientation of the slide vanes 18 and therefore decreases the unit displacement of the vane pump 10.

The unique design of the slide stop 38 and the slide seal 44 bias the pressure required to initiate this slide ring movement and cause the pressure signal to act on a larger area once the slide ring 20 begins to move. This results in a relatively flat oil pressure regulation curve. As the slide ring 20 moves and the unit displacement of the vane pump 10 decreases, the vane pump 10 pumps relatively less oil at each rotational cycle. Thus, a steady oil pressure is maintained while the torque required to drive the pump is proportionately reduced. When the oil pressure reaches a maximum, as may occur under cold engine oil conditions, the pressure relief valve 60 opens to control the maximum pressure by bypassing oil from the outlet of the vane pump 10 back into the oil pan 58.

Several additional features are included in the specific embodiment of variable displacement vane engine oil pump just described:

To maximize the length of the pump extension below the rear main bearing cap, the slide vanes are made longer and narrower than is common in vane pump design. In particular, the vanes have an aspect ratio (length/width) of about 2:1, which differs from a usual 1:1 ratio. The high ratio allows the pump to maintain high volumetric efficiency without the use of a side face seal. Depending upon space available, the aspect ratio may be varied substantially in particular engine applications.

Placement of the inlet and outlet ports in opposite sides of the pump vanes provides through oil flow in the pumping chambers which reduces the entrapment of gases in the chambers.

The integration of the slide spring tab, slide stop and slide seal support into a single flange provides efficient packaging of the pump. It also provides the feature of biasing initial movement of the slide ring to increase the effect of pressure in the control chamber to reduce displacement of the pump rotor after movement of the slide stop 38 away from the housing protrusion 42. The location of the slide stop 38 relative to the protrusion 42 can be adjusted to achieve the desired pressure biasing for a particular engine application.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. Lubrication system for an internal combustion engine including a cylinder block, crankshaft main bearings supported in the cylinder block, an oil pan mounted below the block for containing lubricating oil, and lubrication passages in the engine for supplying pressurized oil to the main bearings and other components of the engine, the lubrication system further comprising:

a variable displacement oil pump supported on the engine block and connected to draw oil from the oil pan and to supply pressurized oil to various engine components, the pump defining variable displacement pumping chambers for carrying oil from an inlet to a pressurized outlet; and a displacement control for varying displacement of the pumping chambers to control the system oil pressure in a predetermined manner;

wherein the pump is a vane pump having slide vanes carried by a rotor rotatable in a housing, and the displacement control includes:

a slide ring in the housing and pivotable about a wall thereof, the ring being internally engaged by the vanes to form the pumping chambers and externally defining a pressure chamber within the housing and open to one side of the slide ring;

whereby oil pressure in the pressure chamber urges the slide ring to pivot in a direction to reduce displacement of the pumping chambers and control oil pressure in the lubrication system.

2. A lubrication system as in claim 1 including a signal port connecting the pressure chamber with a source of system oil pressure to cause increasing system pressure to reduce displacement of the pumping chambers.

3. A lubrication system as in claim 2 wherein the pump is mounted on a crankshaft main bearing cap and an oil passage through the cap transmits main bearing oil pressure to the pump signal port.

4. A lubrication system as in claim 1 wherein the pump is suspended in the oil pan and vertical pump length is minimized by making the slide vanes narrow with a length to width aspect ratio greater than 1.5:1.

5. A lubrication system as in claim 4 wherein the vane aspect ratio is about 2.0:1.

6. A lubrication system as in claim 1 wherein the pump is suspended in the oil pan and includes an integral oil pick-up tube to draw oil from the oil pan below the pump.

7. A lubrication system as in claim 1 including a pump drive having a near vertical drive shaft connected with the pump and driven by a driven gear from a camshaft mounted drive gear of the engine.

8. A lubrication system as in claim 1 including means biasing the slide ring in a direction opposite to the force of pressure in the pressure chamber to establish a biasing force to be overcome by control pressure in the pressure chamber for movement of the slide ring to reduce displacement of the pumping chambers.

9. A lubrication system as in claim 1 including a pivot at the wall on one side of the slide ring and a flange extending from an opposite side of the slide ring, the flange including a seal engaging the housing wall to limit oil leakage from the pressure chamber, and a slide stop engagable with a protrusion of the wall inward of the seal and engaged by the stop in a maximum displacement position of the slide ring in which the stop reduces the area of the slide ring exposed to the pressure chamber;

whereby, when oil in the pressure chamber forces the slide ring stop away from the housing protrusion, the pressure chamber oil pressure acts against an increased area of the slide ring to further reduce displacement of the pumping chambers and limit the initial increase in system oil pressure.

10. A lubrication system as in claim 9 including a biasing spring acting between the housing wall and a slide spring tab on the slide ring flange opposite the slide stop.

11. A variable displacement engine oil vane pump comprising:

pumping chambers defined by slide vanes carried by a rotor rotatable in a housing; and a displacement control for controlling displacement of the pumping chambers; the displacement control including:

a slide ring in the housing and pivotably connected to a wall of the housing by a slide ring pivot, the ring being internally engaged by the vanes and externally defining a pressure chamber within the housing and open to one side of the slide ring; and a flange extending from an opposite side of the slide ring, the flange including a seal engaging the housing wall to limit oil leakage from the pressure chamber and a slide stop engagable with a protrusion of the wall inward of the seal and engaged by the stop in a maximum displacement position of the slide ring in which the stop reduces the area of the slide ring exposed to the pressure chamber;

whereby, when control oil in the pressure chamber forces the slide ring stop away from the housing protrusion, the control oil pressure acts against an increased area of the slide ring to further reduce displacement of the pumping chambers.

12. A pump as in claim 11 including means biasing the slide ring in a direction opposite to the force of control pressure in the pressure chamber to establish a biasing force to be overcome by the control pressure for movement of the slide ring to reduce displacement of the pumping chambers.

13. A pump as in claim 12 wherein the biasing means is a spring acting between the housing wall and a slide spring stop on the slide spring flange opposite from the slide stop.

14. A pump as in claim 11 wherein axial pump length is minimized by making the slide vanes narrow with a length to width aspect ratio greater than 1.5:1.

15. A variable displacement vane oil pump for an internal combustion engine comprising:

a housing having a peripheral wall and sides defining an enclosure;

a rotor rotatable in the housing on a fixed axis, the rotor having a plurality of slide vanes internally engaging a slide ring to define pumping chambers;

the slide ring being pivotally connected to the housing wall by a slide ring pivot and pivotable to vary the displacement of the pumping chambers;

an inlet port and an outlet port communicating with the pumping chambers within the slide ring;

a flange connected to the slide ring opposite from the slide ring pivot, the flange including a slide stop and carrying a slide seal;

the slide stop contacting a protrusion on the inner wall of the housing when the pump is operating at maximum displacement;

the slide seal engaging the housing wall radially beyond the slide stop;

a pressure control chamber defined internally by the housing wall, the slide ring pivot, the slide ring, the slide stop and the slide seal;

a pressure signal port connecting with the pressure control chamber; and a reaction spring urging the slide stop toward the housing wall protrusion;

whereby, when control pressure in the pressure control chamber moves the slide stop away from the protrusion, the effective area of control pressure acting on the slide ring and slide stop is increased to further reduce displacement of the pump thereby control pump outlet pressure.

16. A pump as in claim 15, wherein the inlet and outlet ports are located in the sides at opposite ends of the pumping chambers.

17. A pump as in claim 15, including an integral oil pick-up tube extending downward from the inlet port such that oil can be drawn into the inlet port from a region below the pump.

18. A pump as in claim 15, wherein a modular pressure relief ball valve assembly is fitted to an outlet passage of the pump.

* * * * *